US009348272B2

(12) United States Patent
Tamaki et al.

(10) Patent No.: US 9,348,272 B2
(45) Date of Patent: May 24, 2016

(54) FIXING DEVICE INCLUDING A REINFORCED HEAT SHIELD AND IMAGE FORMING APPARATUS

(71) Applicants: Shuntaroh Tamaki, Kanagawa (JP); Takayuki Seki, Kanagawa (JP); Hiroshi Yoshinaga, Chiba (JP); Yuji Arai, Kanagawa (JP); Ryuuichi Mimbu, Kanagawa (JP); Yoshiki Yamaguchi, Kanagawa (JP); Yutaka Ikebuchi, Kanagawa (JP); Kazuya Saito, Kanagawa (JP); Toshihiko Shimokawa, Kanagawa (JP); Shuutaroh Yuasa, Kanagawa (JP)

(72) Inventors: Shuntaroh Tamaki, Kanagawa (JP); Takayuki Seki, Kanagawa (JP); Hiroshi Yoshinaga, Chiba (JP); Yuji Arai, Kanagawa (JP); Ryuuichi Mimbu, Kanagawa (JP); Yoshiki Yamaguchi, Kanagawa (JP); Yutaka Ikebuchi, Kanagawa (JP); Kazuya Saito, Kanagawa (JP); Toshihiko Shimokawa, Kanagawa (JP); Shuutaroh Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/141,334

(22) Filed: Dec. 26, 2013

(65) Prior Publication Data

US 2014/0270872 A1 Sep. 18, 2014

(30) Foreign Application Priority Data

Mar. 15, 2013 (JP) ..... 2013-053785

(51) Int. Cl.
*G03G 15/20* (2006.01)
*G03G 21/18* (2006.01)

(52) U.S. Cl.
CPC ..... *G03G 15/2017* (2013.01); *G03G 15/2042* (2013.01); *G03G 15/2053* (2013.01); *G03G 21/1832* (2013.01); *G03G 2215/2035* (2013.01)

(58) Field of Classification Search
CPC ..... G03G 15/2017; G03G 15/2042; G03G 15/2053; G03G 21/1832; G03G 2215/20
USPC ..... 399/328–329
See application file for complete search history.

(56) References Cited

U.S. PATENT DOCUMENTS 5,045,959 A * 9/1991 Ishimatsu ..... 360/133
6,049,691 A * 4/2000 Abe et al. ..... 399/330

(Continued)

FOREIGN PATENT DOCUMENTS

CN 101673078 A 3/2010
JP 2004-264785 9/2004

(Continued)

OTHER PUBLICATIONS

English Translation of Saito, Seiji. Fixing Device, and Image Forming Apparatus with the Fixing Device, Mar. 13, 2008. Japanese Patent Office. JP2008-058833.*

(Continued)

*Primary Examiner* — Clayton E Laballe
*Assistant Examiner* — Trevor J Bervik
(74) *Attorney, Agent, or Firm* — Duft Bornsen & Fettig LLP

(57) ABSTRACT

A fixing device includes a fixing rotary body rotatable in a predetermined direction of rotation and a heater disposed opposite and heating the fixing rotary body. An opposed body contacts the fixing rotary body to form a fixing nip therebetween through which a recording medium is conveyed. A heat shield is movable in a circumferential direction of the fixing rotary body and interposed between the heater and the fixing rotary body to shield the fixing rotary body from the heater. A driver is connected to the heat shield to drive and move the heat shield between a shield position where the heat shield is interposed between the heater and the fixing rotary body to shield the fixing rotary body from the heater and a retracted position where the heat shield is retracted from the shield position. A reinforcement is mounted on a long edge of the heat shield.

21 Claims, 9 Drawing Sheets

(56) References Cited

U.S. PATENT DOCUMENTS

| | | | | |
|---|---|---|---|---|
| 7,268,326 | B2 * | 9/2007 | Yamamoto et al. | 219/619 |
| 7,348,524 | B2 * | 3/2008 | Takematsu et al. | 219/619 |
| 7,437,113 | B2 * | 10/2008 | Suzuki et al. | 399/328 |
| 7,604,286 | B2 * | 10/2009 | Watanabe et al. | 296/210 |
| 7,871,093 | B2 * | 1/2011 | Ogawa et al. | 280/124.166 |
| 7,925,177 | B2 * | 4/2011 | Ishii et al. | 399/67 |
| 7,949,290 | B2 * | 5/2011 | Yoshikawa | 399/328 |
| 2006/0088329 | A1 | 4/2006 | Suzuki et al. | |
| 2010/0067929 | A1 | 3/2010 | Seki | |
| 2010/0143766 | A1 * | 6/2010 | Yoshitomi et al. | 429/34 |
| 2011/0274453 | A1 * | 11/2011 | Shimokawa et al. | 399/45 |
| 2012/0020710 | A1 * | 1/2012 | Motoki | 399/334 |
| 2012/0157220 | A1 * | 6/2012 | Iwade | 473/238 |
| 2012/0195651 | A1 * | 8/2012 | Ishida | 399/320 |
| 2012/0295093 | A1 * | 11/2012 | Belpaire et al. | 428/223 |
| 2014/0072355 | A1 | 3/2014 | Tamaki et al. | |

FOREIGN PATENT DOCUMENTS

| | | |
|---|---|---|
| JP | 2008-058833 | 3/2008 |
| JP | 2008-139779 | 6/2008 |
| JP | 2010-066583 | 3/2010 |

OTHER PUBLICATIONS

U.S. Appl. No. 13/929,920, filed Jun. 28, 2013.
U.S. Appl. No. 13/930,582, filed Jun. 28, 2013.
U.S. Appl. No. 14/010,823, filed Aug. 27, 2013.
U.S. Appl. No. 14/013,206, filed Aug. 29, 2013.
U.S. Appl. No. 14/014,653, filed Aug. 30, 2013.
U.S. Appl. No. 14/015,035, filed Aug. 30, 2013.
U.S. Appl. No. 14/024,931, filed Sep. 12, 2013.
U.S. Appl. No. 14/072,027, filed Nov. 5, 2013.

* cited by examiner

FIXING DEVICE INCLUDING A REINFORCED HEAT SHIELD AND IMAGE FORMING APPARATUS

CROSS-REFERENCE TO RELATED APPLICATION

This patent application is based on and claims priority pursuant to 35 U.S.C. §119 to Japanese Patent Application No. 2013-053785, filed on Mar. 15, 2013, in the Japanese Patent Office, the entire disclosure of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotary body heated by a heater and an opposed body contacting the fixing rotary body to form a fixing nip therebetween through which a recording medium bearing a toner image is conveyed. As the fixing rotary body and the opposed body rotate and convey the recording medium bearing the toner image through the fixing nip, the fixing rotary body heated to a predetermined fixing temperature and the opposed body together heat and melt toner of the toner image, thus fixing the toner image on the recording medium.

Since the recording medium passing through the fixing nip draws heat from the fixing rotary body, a temperature sensor detects the temperature of the fixing rotary body to maintain the fixing rotary body at a desired temperature. Conversely, at each lateral end of the fixing rotary body in an axial direction thereof, the recording medium is not conveyed over the fixing rotary body and therefore does not draw heat from the fixing rotary body. Accordingly, after a plurality of recording media is conveyed through the fixing nip continuously, a non-conveyance span situated at each lateral end of the fixing rotary body may overheat.

To address this circumstance, the fixing device may incorporate a heat shield to shield the non-conveyance span of the fixing rotary body from the heater, thus preventing overheating of the fixing rotary body as disclosed by JP-2008-058833-A and JP-2008-139779-A, for example. However, as the heat shield shields the fixing rotary body from the heater, the heat shield is heated by the heater. Accordingly, if the heat shield has an increased thermal capacity, the heat shield may absorb heat from the heater unnecessarily, wasting energy.

To address this circumstance, the heat shield may be made of a thin plate having a decreased thermal capacity. However, the thin plate of the heat shield may degrade the mechanical strength of the heat shield.

SUMMARY

This specification describes below an improved fixing device. In one exemplary embodiment, the fixing device includes a fixing rotary body rotatable in a predetermined direction of rotation and a heater disposed opposite and heating the fixing rotary body. An opposed body contacts the fixing rotary body to form a fixing nip therebetween through which a recording medium is conveyed. A heat shield is movable in a circumferential direction of the fixing rotary body and interposed between the heater and the fixing rotary body to shield the fixing rotary body from the heater. A driver is connected to the heat shield to drive and move the heat shield between a shield position where the heat shield is interposed between the heater and the fixing rotary body to shield the fixing rotary body from the heater and a retracted position where the heat shield is retracted from the shield position. A reinforcement is mounted on a long edge of the heat shield.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
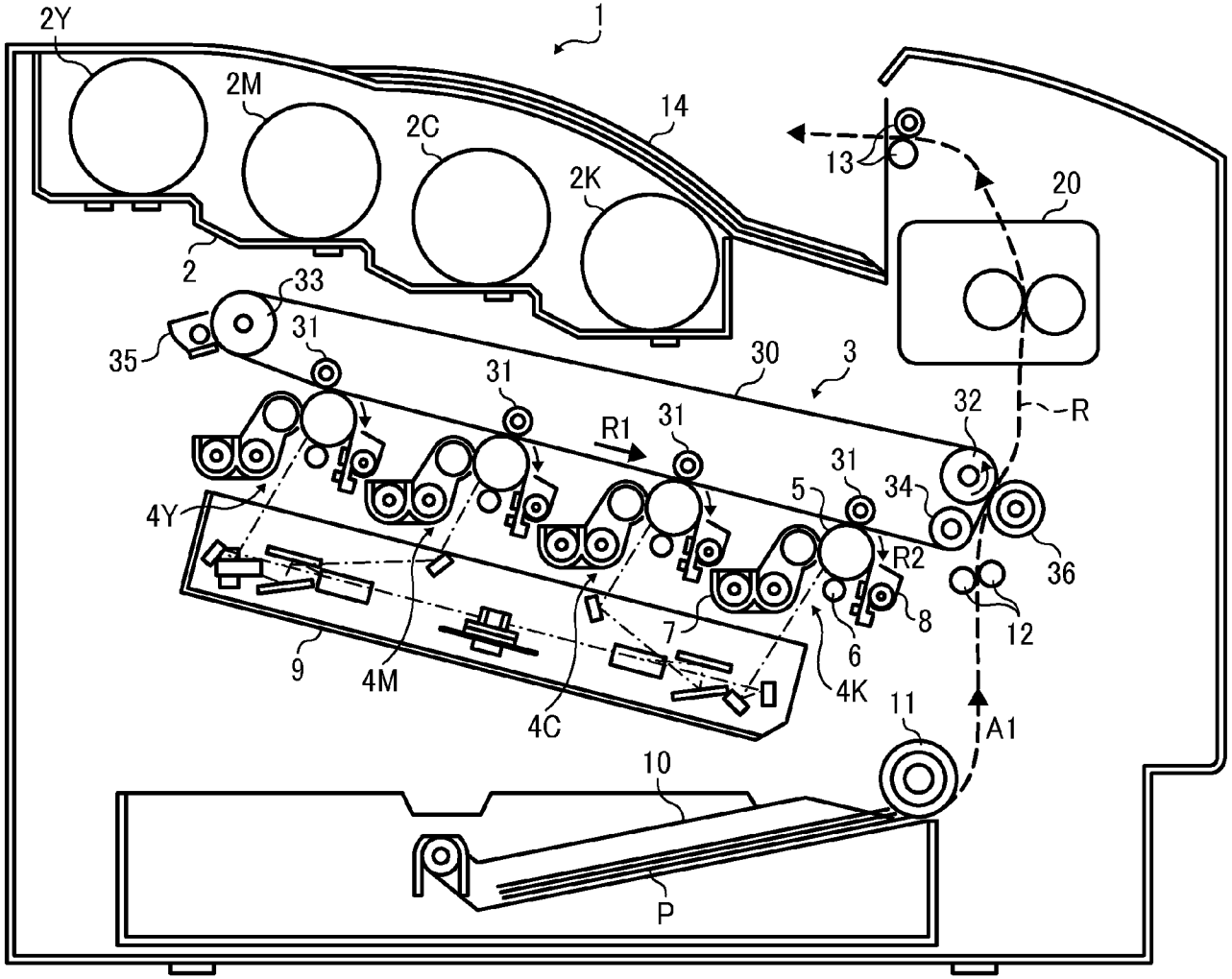
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, overhead projector (OHP) transparencies, and the like. Additionally, a bypass tray that loads postcards, envelopes, OHP transparencies, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 serving as a timing roller pair feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 1, a description is provided of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. As the recording medium P comes into contact with the registration roller pair 12, the registration roller pair 12 that interrupts its rotation temporarily halts the recording medium P.

Thereafter, the registration roller pair 12 resumes its rotation and conveys the recording medium P to the secondary transfer nip at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. The transfer electric field secondarily transfers the yellow, magenta, cyan, and black toner images constituting the color toner image formed on the intermediate transfer belt 30 onto the recording medium P collectively. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
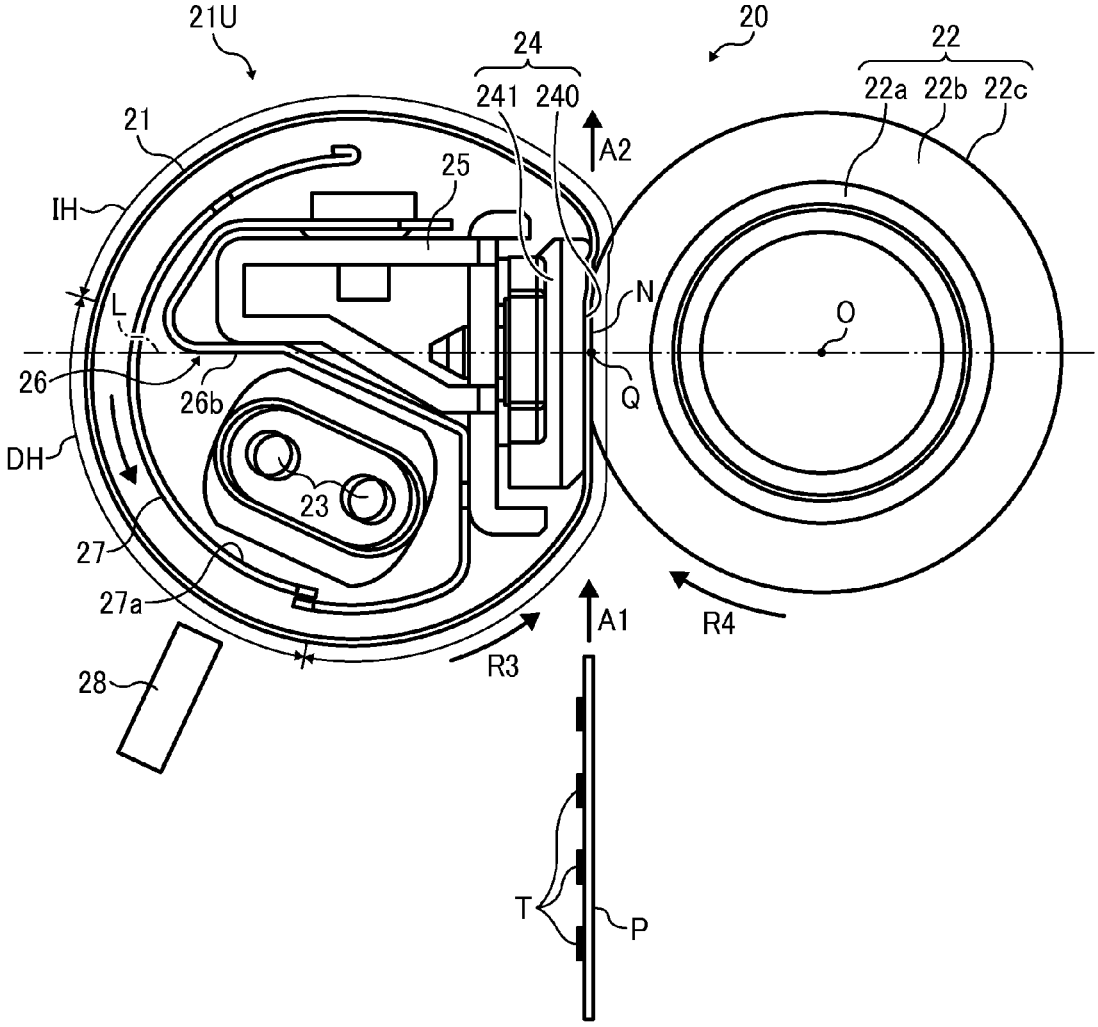
FIG. 2 is a vertical sectional view of a fixing device incorporated in the image forming apparatus shown in FIG. 1 illustrating a heat shield incorporated therein that is situated at a shield position.
Figure 3:
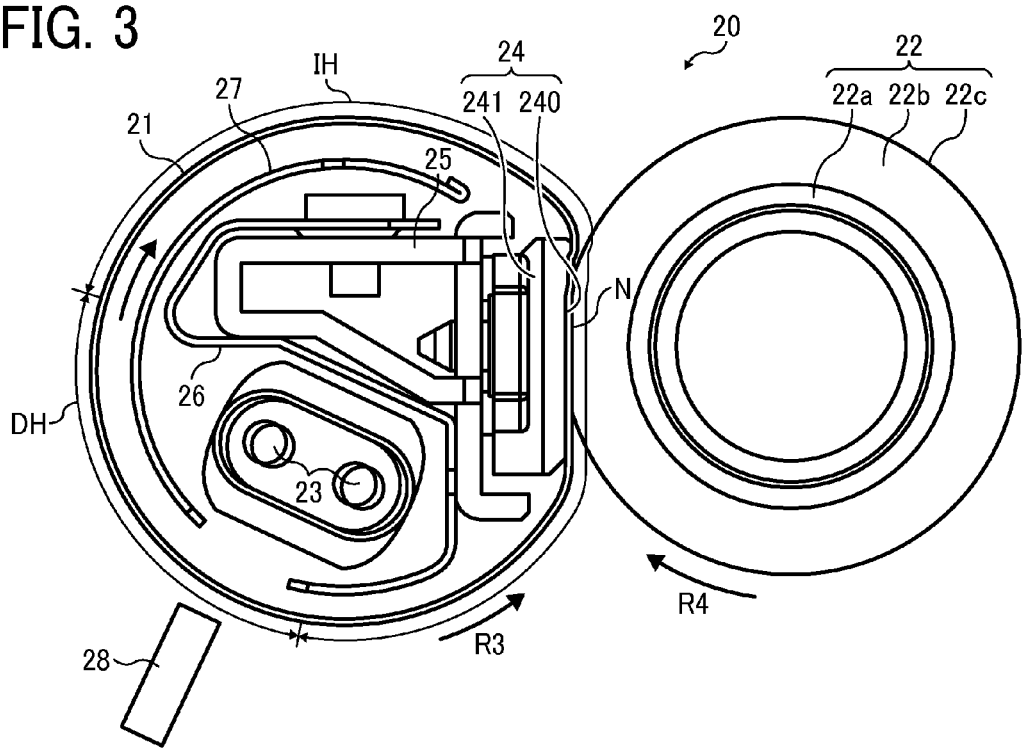
FIG. 3 is a vertical sectional view of the fixing device shown in FIG. 2 illustrating the heat shield situated at a retracted position.

With reference to FIGS. 2 and 3, a description is provided of a construction of the fixing device 20 incorporated in the image forming apparatus 1 described above.

FIG. 2 is a vertical sectional view of the fixing device 20 illustrating a heat shield 27 incorporated therein that is situated at a shield position. FIG. 3 is a vertical sectional view of the fixing device 20 illustrating the heat shield 27 situated at a retracted position.

As shown in FIG. 2, the fixing device 20 (e.g., a fuser) includes a fixing belt 21 serving as a fixing rotary body or an endless belt formed into a loop and rotatable in a rotation direction R3; a pressing roller 22 serving as an opposed body disposed opposite an outer circumferential surface of the fixing belt 21 and rotatable in a rotation direction R4 counter to the rotation direction R3 of the fixing belt 21; a halogen heater pair 23 serving as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater pair 23 toward the fixing belt 21; the heat shield 27 interposed between the halogen heater pair 23 and the fixing belt 21 to shield the fixing belt 21 from light radiated from the halogen heater pair 23; and a temperature sensor 28 serving as a temperature detector disposed opposite the outer circumferential surface of the fixing belt 21 and detecting the temperature of the fixing belt 21.

The fixing belt 21 and the components disposed inside the loop formed by the fixing belt 21, that is, the halogen heater pair 23, the nip formation assembly 24, the stay 25, the reflector 26, and the heat shield 27, may constitute a belt unit 21U separably coupled with the pressing roller 22.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated to a predetermined fixing temperature quickly. However, as the pressing roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the fixing belt 21 incorporates the elastic layer having a thickness not smaller than about 100 micrometers. The elastic layer having the thickness not smaller than about 100 micrometers elastically deforms to absorb slight surface asperities of the fixing belt 21, preventing variation in gloss of the toner image T on the recording medium P.

According to this exemplary embodiment, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a predetermined length in the recording medium conveyance direction A1. According to this exemplary embodiment, the pressing roller 22 is pressed against the fixing belt 21. Alternatively, the pressing roller 22 may merely contact the fixing belt 21 with no pressure therebetween.

A driver (e.g., a motor) disposed inside the image forming apparatus 1 depicted in FIG. 1 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21.

According to this exemplary embodiment, the pressing roller 22 is a solid roller. Alternatively, the pressing roller 22 may be a hollow roller. In this case, a heater such as a halogen heater may be disposed inside the hollow roller. The elastic layer 22*b* may be made of solid rubber. Alternatively, if no heater is situated inside the pressing roller 22, the elastic layer 22*b* may be made of sponge rubber. The sponge rubber is more preferable than the solid rubber because it has an increased insulation that draws less heat from the fixing belt 21.

A detailed description is now given of a configuration of the halogen heater pair 23.

The halogen heater pair 23 is situated inside the loop formed by the fixing belt 21 and upstream from the fixing nip N in the recording medium conveyance direction A1. For example, the halogen heater pair 23 is situated lower than and upstream from a hypothetical line L passing through a center Q of the fixing nip N in the recording medium conveyance direction A1 and an axis O of the pressing roller 22 in FIG. 2. The power supply situated inside the image forming apparatus 1 supplies power to the halogen heater pair 23 so that the halogen heater pair 23 heats the fixing belt 21. A controller (e.g., a processor), that is, a central processing unit (CPU) provided with a random-access memory (RAM) and a read-only memory (ROM), for example, operatively connected to the halogen heater pair 23 and the temperature sensor 28 controls the halogen heater pair 23 based on the temperature of the fixing belt 21 detected by the temperature sensor 28 so as to adjust the temperature of the fixing belt 21 to a desired fixing temperature. Alternatively, the controller may be operatively connected to a temperature sensor disposed opposite the pressing roller 22 to detect the temperature of the pressing roller 22 so that the controller predicts the temperature of the fixing belt 21 based on the temperature of the pressing roller 22 detected by the temperature sensor, thus controlling the halogen heater pair 23.

According to this exemplary embodiment, two halogen heaters constituting the halogen heater pair 23 are situated inside the loop formed by the fixing belt 21. Alternatively, one halogen heater or three or more halogen heaters may be situated inside the loop formed by the fixing belt 21 according to the sizes of the recording media P available in the image forming apparatus 1. Alternatively, instead of the halogen heater pair 23, a resistance heat generator, a carbon heater, or the like may be employed as a heater that heats the fixing belt 21.

A detailed description is now given of a construction of the nip formation assembly 24.

The nip formation assembly 24 includes a base pad 241 and a slide sheet 240 (e.g., a low-friction sheet) covering an outer surface of the base pad 241. For example, the slide sheet 240 covers an opposed face of the base pad 241 disposed opposite the fixing belt 21. A longitudinal direction of the base pad 241 is parallel to an axial direction of the fixing belt 21 or the pressing roller 22. The base pad 241 receives pressure from the pressing roller 22 to define the shape of the fixing nip N. According to this exemplary embodiment, the fixing nip N is planar in cross-section as shown in FIG. 2. Alternatively, the fixing nip N may be concave with respect to the pressing roller 22 or have other shapes. The slide sheet 240 reduces friction between the base pad 241 and the fixing belt 21 sliding over the base pad 241. Alternatively, the base pad 241 may be made of a low friction material. In this case, the slide sheet 240 is not interposed between the base pad 241 and the fixing belt 21.

The base pad 241 is made of a heat resistant material resistant against temperatures of 200 degrees centigrade or higher to prevent thermal deformation of the nip formation assembly 24 by temperatures in a fixing temperature range desirable to fix the toner image T on the recording medium P, thus retaining the shape of the fixing nip N and quality of the toner image T formed on the recording medium P. For example, the base pad 241 is made of general heat resistant resin such as polyether sulfone (PES), polyphenylene sulfide (PPS), liquid crystal polymer (LCP), polyether nitrile (PEN), polyamide imide (PAI), polyether ether ketone (PEEK), or the like.

The base pad 241 is mounted on and supported by the stay 25. Accordingly, even if the base pad 241 receives pressure from the pressing roller 22, the base pad 241 is not bent by the pressure and therefore produces a uniform nip width throughout the entire width of the pressing roller 22 in the axial direction thereof. The stay 25 is made of metal having an increased mechanical strength, such as stainless steel and iron, to prevent bending of the nip formation assembly 24. The base pad 241 is also made of a rigid material having an increased mechanical strength. For example, the base pad 241 is made of resin such as LCP, metal, ceramic, or the like.

A detailed description is now given of a construction of the reflector 26.

The reflector 26 is mounted on and supported by the stay 25 and disposed opposite the halogen heater pair 23. The reflector 26 reflects light or heat radiated from the halogen heater pair 23 thereto onto the fixing belt 21, suppressing conduction of heat from the halogen heater pair 23 to the stay 25. Thus, the reflector 26 facilitates efficient heating of the fixing belt 21, saving energy. For example, the reflector 26 is made of aluminum, stainless steel, or the like. If the reflector 26 includes an aluminum base treated with silver-vapor-deposition to decrease radiation and increase reflectance of light, the reflector 26 facilitates heating of the fixing belt 21.

A detailed description is now given of a configuration of the heat shield 27.

The heat shield 27 is a thin plate, having a thickness in a range of from about 0.1 mm to about 1.0 mm, curved in a circumferential direction of the fixing belt 21 along the inner circumferential surface thereof. The heat shield 27 is made of a heat resistant material, for example, metal such as aluminum, iron, and stainless steel or ceramic. The heat shield 27 is movable in the circumferential direction of the fixing belt 21. As shown in FIG. 2, a circumference of the fixing belt 21 is divided into two sections: a circumferential, direct heating span DH where the halogen heater pair 23 is disposed opposite and heats the fixing belt 21 directly and a circumferential, indirect heating span IH where the halogen heater pair 23 is disposed opposite the fixing belt 21 indirectly via the components other than the heat shield 27, that is, the reflector 26, the stay 25, the nip formation assembly 24, and the like. The heat shield 27 moves to the shield position shown in FIG. 2 where the heat shield 27 is disposed opposite the halogen heater pair 23 directly in the direct heating span DH to shield the fixing belt 21 from the halogen heater pair 23.

Conversely, the heat shield 27 moves to the retracted position shown in FIG. 3 where the heat shield 27 retracts from the direct heating span DH to the indirect heating span IH and therefore is disposed opposite the halogen heater pair 23 indirectly. That is, the heat shield 27 is behind the reflector 26 and the stay 25 and therefore disposed opposite the halogen heater pair 23 via the reflector 26 and the stay 25. Thus, the heat shield 27 does not shield the fixing belt 21 from the halogen heater pair 23.

Figure 4:
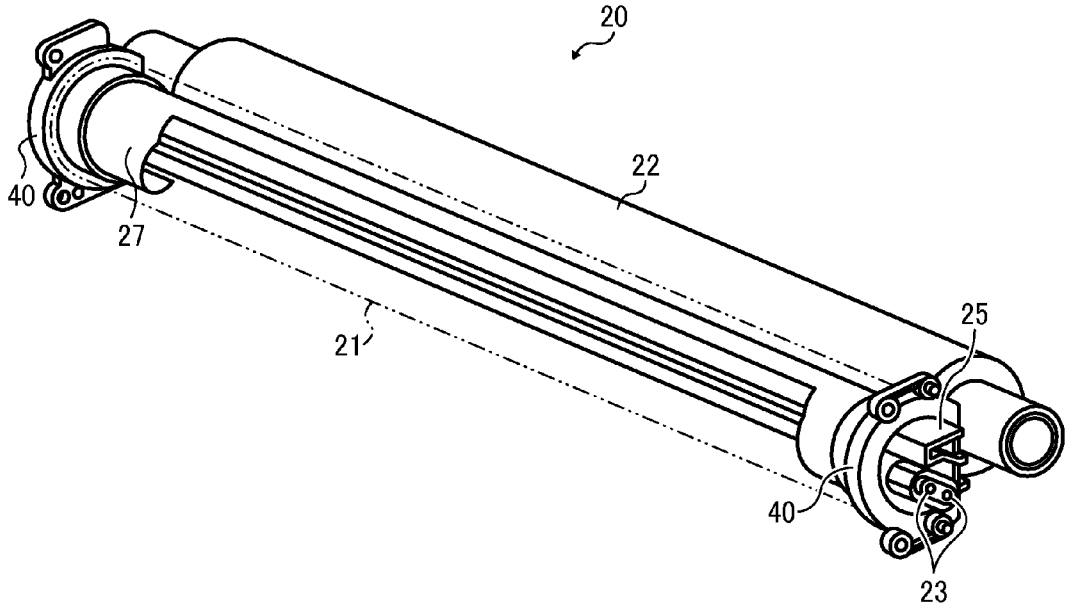
FIG. 4 is a partial perspective view of the fixing device shown in FIG. 3.

With reference to FIG. 4, a description is provided of a configuration of flanges 40 incorporated in the fixing device 20.

FIG. 4 is a partial perspective view of the fixing device 20. As shown in FIG. 4, the flanges 40 serving as a belt holder are inserted into both lateral ends of the fixing belt 21 in the axial direction thereof, respectively, to rotatably support the fixing belt 21. Both lateral ends of the flanges 40, the halogen heater pair 23, and the stay 25 in the axial direction of the fixing belt 21 are mounted on and supported by a pair of side plates of the fixing device 20, respectively.

Figure 5:
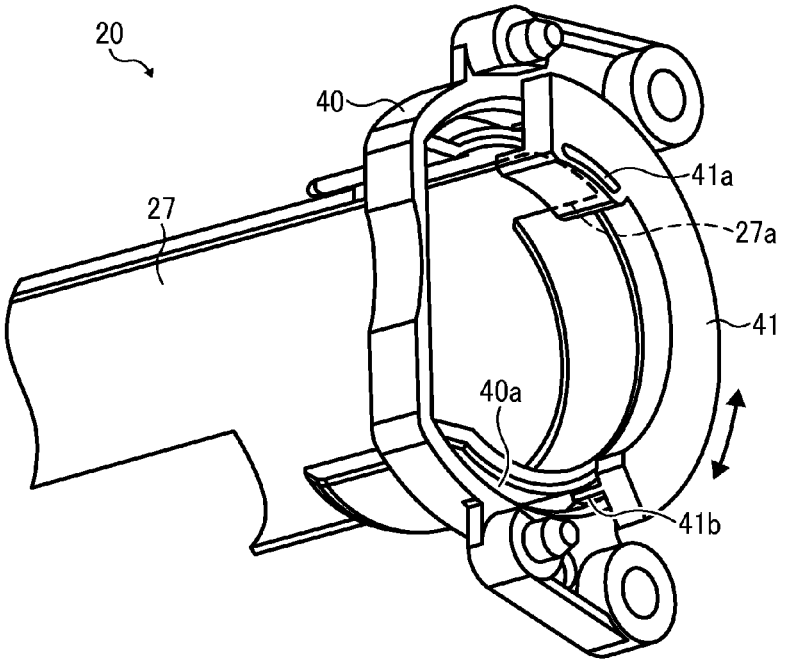
FIG. 5 is a partial perspective view of the fixing device shown in FIG. 2 illustrating one lateral end of the heat shield in an axial direction thereof.

With reference to FIG. 5, a description is provided of a construction of a support mechanism that supports the heat shield 27.

FIG. 5 is a partial perspective view of the fixing device 20 illustrating one lateral end of the heat shield 27 in the axial direction of the fixing belt 21. As shown in FIG. 5, the heat shield 27 is supported by an arcuate slider 41 rotatably or slidably attached to the flange 40. For example, a projection 27*a* disposed at each lateral end of the heat shield 27 in the axial direction of the fixing belt 21 is inserted into a hole 41*a* produced in the slider 41. Thus, the heat shield 27 is attached to the slider 41. The slider 41 includes a tab 41*b* projecting inboard in the axial direction of the fixing belt 21 toward the heat shield 27. As the tab 41*b* of the slider 41 is inserted into an arcuate groove 40*a* produced in the flange 40, the slider 41 is slidably movable in the groove 40*a*. Accordingly, the heat shield 27, together with the slider 41, is rotatable or movable in a circumferential direction of the flange 40. The flange 40 and the slider 41 are made of resin.

Although FIG. 5 illustrates the support mechanism that supports the heat shield 27 at one lateral end thereof in the axial direction of the fixing belt 21, another lateral end of the heat shield 27 in the axial direction of the fixing belt 21 is also supported by the support mechanism shown in FIG. 5. Thus, another lateral end of the heat shield 27 is also rotatably or movably supported by the slider 41 slidable in the groove 40*a* of the flange 40.

Figure 6:
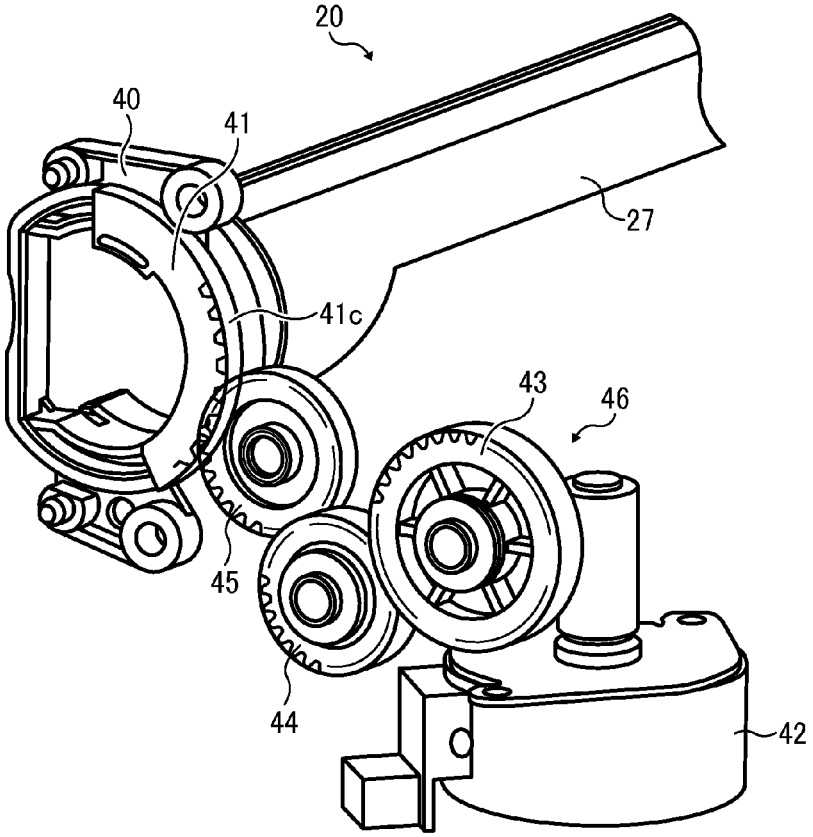
FIG. 6 is a partial perspective view of the fixing device shown in FIG. 2 illustrating a driver incorporated therein.

With reference to FIG. 6, a description is provided of a construction of a driver 46 that drives and rotates the heat shield 27.

FIG. 6 is a partial perspective view of the fixing device 20 illustrating the driver 46. As shown in FIG. 6, the driver 46 includes a motor 42 serving as a driving source and a plurality of gears 43, 44, and 45 constituting a gear train. The gear 43 serving as one end of the gear train is connected to the motor 42. The gear 45 serving as another end of the gear train is connected to a gear 41*c* produced on the slider 41 along a circumferential direction thereof. Accordingly, as the motor 42 is driven, a driving force is transmitted from the motor 42 to the gear 41*c* of the slider 41 through the gear train, that is, the gears 43 to 45, thus rotating the heat shield 27 supported by the slider 41.

According to this exemplary embodiment, the driver 46 is connected to one end of the heat shield 27 in a longitudinal direction thereof parallel to the axial direction of the fixing belt 21 so that a driving force from the driver 46 is transmitted to one end of the heat shield 27 in the longitudinal direction thereof. Alternatively, the driver 46 may be connected to each end of the heat shield 27 in the longitudinal direction thereof to transmit a driving force to each end of the heat shield 27 in the longitudinal direction thereof. However, the driver 46 connected to one end of the heat shield 27 in the longitudinal direction thereof as shown in FIG. 6 reduces the number of parts constituting the driver 46, resulting in reduced manufacturing costs and weight reduction of the fixing device 20. It is to be noted that the driver 46 may be located in either the image forming apparatus 1 or the fixing device 20.

Figure 7:
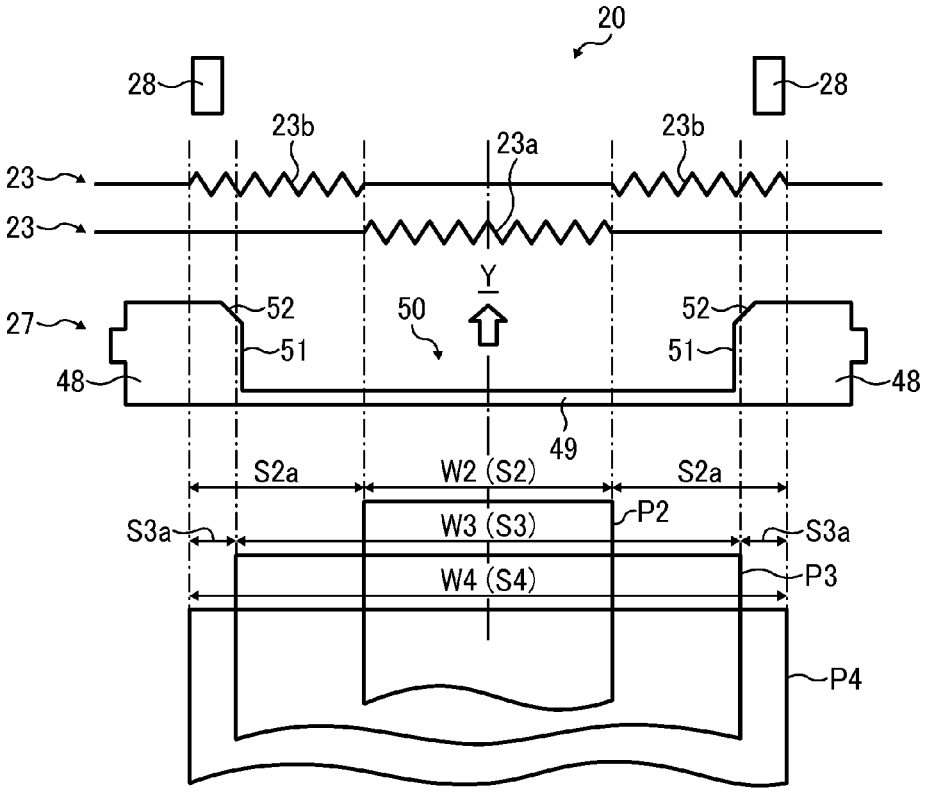
FIG. 7 is a schematic diagram of the fixing device shown in FIG. 3 illustrating a halogen heater pair incorporated therein, the heat shield, and recording media of various sizes.

With reference to FIG. 7, a description is provided of a relation between the shape of the heat shield 27, heat generators of the halogen heater pair 23, and the sizes of recording media.

FIG. 7 is a schematic diagram of the fixing device 20 illustrating the halogen heater pair 23, the heat shield 27, and recording media of various sizes.

First, a detailed description is given of the shape of the heat shield 27.

As shown in FIG. 7, the heat shield 27 includes a pair of shield portions 48, constituting both lateral ends of the heat shield 27 in the axial direction thereof; a bridge 49 bridging the shield portions 48 in the axial direction of the heat shield 27; and a recess 50 defined by the shield portions 48 and the bridge 49, and in turn itself defining an inboard edge of each shield portion 48. The shield portions 48 are disposed opposite both lateral ends of the halogen heater pair 23 in the axial direction of the fixing belt 21, respectively, to shield both lateral ends of the fixing belt 21 in the axial direction thereof from the halogen heater pair 23. The recess 50 between the pair of shield portions 48 in the axial direction of the heat shield 27 does not shield the fixing belt 21 from the halogen heater pair 23 and therefore allows light radiated from the halogen heater pair 23 to irradiate the fixing belt 21.

The inboard edge of each shield portion 48 includes a circumferentially straight edge 51 extending parallel to the circumferential direction of the heat shield 27 in which the heat shield 27 pivots and a sloped edge 52 angled relative to the circumferentially straight edge 51. As shown in FIG. 7, the sloped edge 52 is contiguous to the circumferentially straight edge 51 substantially in a shield direction Y in which the heat shield 27 moves from the retracted position shown in FIG. 3 to the shield position shown in FIG. 2. The sloped edge 52 is angled outboard from the circumferentially straight edge 51 substantially in the shield direction Y such that an interval between the sloped edge 52 and another sloped edge 52 increases. Accordingly, the recess 50 has a uniform, decreased width defined by the circumferentially straight edges 51 in the axial direction of the heat shield 27 and an increased width defined by the sloped edges 52 in the axial direction of the heat shield 27 that increases gradually in the shield direction Y.

Next, a detailed description is given of a relation between the heat generators of the halogen heater pair 23 and the sizes of the recording media.

As shown in FIG. 7, the halogen heater pair 23 has a plurality of heat generators having different lengths in the axial direction of the fixing belt 21 and being situated at different positions in the axial direction of the fixing belt 21 to heat different axial spans on the fixing belt 21 according to the size of the recording medium P. For example, the halogen heater pair 23 is constructed of the lower halogen heater 23 having a center heat generator 23*a* disposed opposite a center of the fixing belt 21 in the axial direction thereof and the upper halogen heater 23 having lateral end heat generators 23*b* disposed opposite both lateral ends of the fixing belt 21 in the axial direction thereof, respectively. The center heat generator 23*a* spans a conveyance span S2 corresponding to a width W2 of a medium recording medium P2 in the axial direction of the fixing belt 21. Conversely, the lateral end heat generators 23*b*, together with the center heat generator 23*a*, span a conveyance span S3 corresponding to a width W3 of a large recording medium P3 greater than the width W2 of the medium recording medium P2 and a conveyance span S4 corresponding to a width W4 of an extra-large recording medium P4 greater than the width W3 of the large recording medium P3.

A detailed description is now given of a relation between the shape of the heat shield 27 and the sizes of the recording media P2, P3, and P4.

Each circumferentially straight edge 51 is situated inboard from and in proximity to an edge of the conveyance span S3 corresponding to the width W3 of the large recording medium P3 in the axial direction of the fixing belt 21. Each sloped edge 52 overlaps the edge of the conveyance span S3.

For example, the medium recording medium P2 is a letter size recording medium having a width W2 of 215.9 mm or an A4 size recording medium having a width W2 of 210 mm. The large recording medium P3 is a double letter size recording medium having a width W3 of 279.4 mm or an A3 size recording medium having a width W3 of 297 mm. The extra-large recording medium P4 is an A3 extension size recording medium having a width W4 of 329 mm. However, the medium recording medium P2, the large recording medium P3, and the extra-large recording medium P4 may include recording media of other sizes. Additionally, the medium, large, and extra-large sizes mentioned herein are relative terms. Hence, instead of the medium, large, and extra-large sizes, small, medium, and large sizes may be used.

With reference to FIG. 2, a description is provided of a fixing operation of the fixing device 20 described above.

As the image forming apparatus 1 depicted in FIG. 1 is powered on, the power supply supplies power to the halogen heater pair 23 and at the same time the driver drives and rotates the pressing roller 22 clockwise in FIG. 2 in the rotation direction R4. Accordingly, the fixing belt 21 rotates counterclockwise in FIG. 2 in the rotation direction R3 in accordance with rotation of the pressing roller 22 by friction between the pressing roller 22 and the fixing belt 21. Alternatively, the driver may also be connected to the fixing belt 21 to drive and rotate the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the fixing belt 21 and the pressing roller 22 pressed against the fixing belt 21. The fixing belt 21 heated by the halogen heater pair 23 heats the recording medium P and at the same time the pressing roller 22 pressed against the fixing belt 21, together with the fixing belt 21, exerts pressure on the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of a separator, the separator separates the recording medium P from the fixing belt 21. Thereafter, the separated recording medium P is discharged by the output roller pair 13 depicted in FIG. 1 onto the outside of the image forming apparatus 1, that is, the output tray 14 where the recording medium P is stocked.

Figure 8:
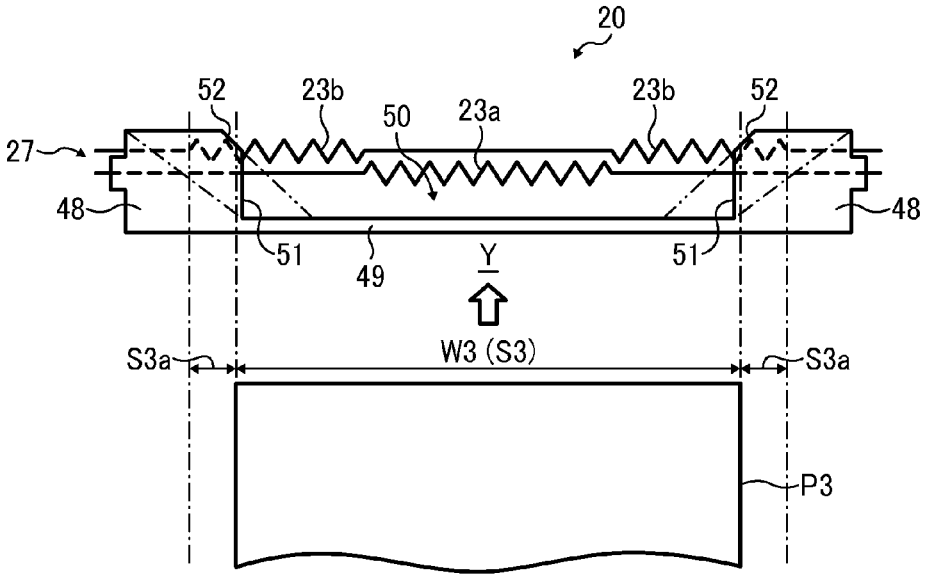
FIG. 8 is a partial schematic diagram of the fixing device shown in FIG. 2 illustrating the heat shield at the shield position.

With reference to FIGS. 7 and 8, a description is provided of control of the halogen heater pair 23 and the heat shield 27 according to the sizes of recording media.

FIG. 8 is a partial schematic diagram of the fixing device 20. As the medium recording medium P2 is conveyed over the fixing belt 21 depicted in FIG. 2, the controller turns on the center heat generator 23*a* to heat the conveyance span S2 of the fixing belt 21 corresponding to the width W2 of the medium recording medium P2. As the extra-large recording medium P4 is conveyed over the fixing belt 21, the controller turns on the lateral end heat generators 23*b* as well as the center heat generator 28*a* to heat the conveyance span S4 of the fixing belt 21 corresponding to the width W4 of the extra-large recording medium P4.

However, the halogen heater pair 23 is configured to heat the conveyance span S2 corresponding to the width W2 of the medium recording medium P2 and the conveyance span S4 corresponding to the width W4 of the extra-large recording medium P4. Accordingly, if the center heat generator 23*a* is turned on as the large recording medium P3 is conveyed over the fixing belt 21, the center heat generator 23*a* does not heat each outboard span S2*a* outboard from the conveyance span S2 in the axial direction of the fixing belt 21. Consequently, the large recording medium P3 is not heated throughout the entire width W3 thereof. Conversely, if the lateral end heat generators 23*b* are turned on in addition to the center heat generator 23*a*, the lateral end heat generators 23*b* and the center heat generator 23*a* heat the conveyance span S4 greater than the conveyance span S3 corresponding to the width W3 of the large recording medium P3. If the large recording medium P3 is conveyed over the fixing belt 21 while the lateral end heat generators 23*b* and the center heat generator 23*a* are turned on, the lateral end heat generators 23*b* may heat both outboard spans S3*a* outboard from the conveyance span S3 corresponding to the width W3 of the large recording medium P3, resulting in overheating of the fixing belt 21 in the outboard spans S3*a*.

To address this circumstance, as the large recording medium P3 is conveyed over the fixing belt 21, the heat shield 27 moves to the shield position as shown in FIG. 8. At the shield position shown in FIG. 8, the shield portions 48 of the heat shield 27 shield the fixing belt 21 in a span in proximity to both side edges of the large recording medium P3 and the outboard spans S3*a*, thus suppressing overheating of the fixing belt 21 in the outboard spans S3*a* where the large recording medium P3 is not conveyed.

When a fixing job is finished or the temperature of the outboard span S3*a* of the fixing belt 21 where the large recording medium P3 is not conveyed decreases to a predetermined threshold and therefore the heat shield 27 is no longer requested to shield the fixing belt 21, the controller moves the heat shield 27 to the retracted position shown in FIG. 3. Thus, the fixing device 20 performs the fixing job precisely by moving the heat shield 27 to the shield position shown in FIG. 2 at a proper time without decreasing the rotation speed of the fixing belt 21 and the pressing roller 22 to convey the large recording medium P3.

Since each shield portion 48 includes the sloped edge 52 as shown in FIG. 7, as the rotation angle of the heat shield 27 changes, the shield portions 48 shield the fixing belt 21 from the lateral end heat generators 23*b* in a variable area. For example, if the number of recording media conveyed through the fixing nip N and a conveyance time for which the recording media are conveyed through the fixing nip N increase, the fixing belt 21 is subject to overheating in a non-conveyance span (e.g., the outboard spans S2*a* and S3*a*) thereof. To address this circumstance, when the number of recording media conveyed through the fixing nip N reaches a predetermined number or when the conveyance time reaches a predetermined conveyance time, the controller moves the heat shield 27 in the shield direction Y to the shield position shown in FIG. 2 where the shield portions 48 are disposed opposite the lateral end heat generators 23*b*, respectively, suppressing overheating of the fixing belt 21 precisely.

The temperature sensor 28 for detecting the temperature of the fixing belt 21 is disposed opposite an axial span on the fixing belt 21 where the fixing belt 21 is subject to overheating. According to this exemplary embodiment, as shown in FIG. 7, the temperature sensor 28 is disposed opposite each outboard span S3*a* outboard from the conveyance span S3 corresponding to the width W3 of the large recording medium P3 because the fixing belt 21 is subject to overheating in the outboard span S3*a*. Since the fixing belt 21 is subject to overheating by light radiated from the lateral end heat generators 23*b*, the temperature sensors 28 are disposed opposite the lateral end heat generators 23*b*, respectively. Although FIG. 7 illustrates the two temperature sensors 28 disposed opposite the conveyance span S4 corresponding to the width W4 of the extra-large recording medium P4, one of the two temperature sensors 28 may be eliminated. Alternatively, the temperature sensor 28 may be located at other positions, for example, the temperature sensor 28 may be disposed opposite a center of the fixing belt 21 in the axial direction thereof. The number of the temperature sensors 28 may be changed arbitrarily. For example, three or more temperature sensors 28 may be aligned in the axial direction of the fixing belt 21.

Figure 9:
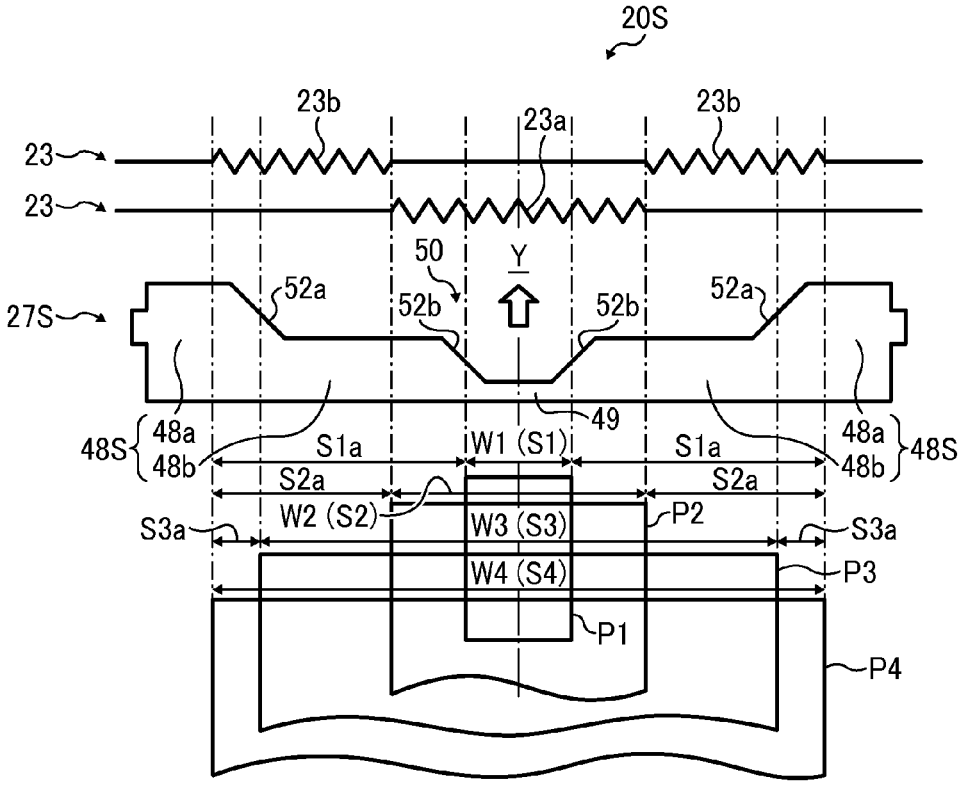
FIG. 9 is a schematic diagram of a fixing device according to another exemplary embodiment.
Figure 10:
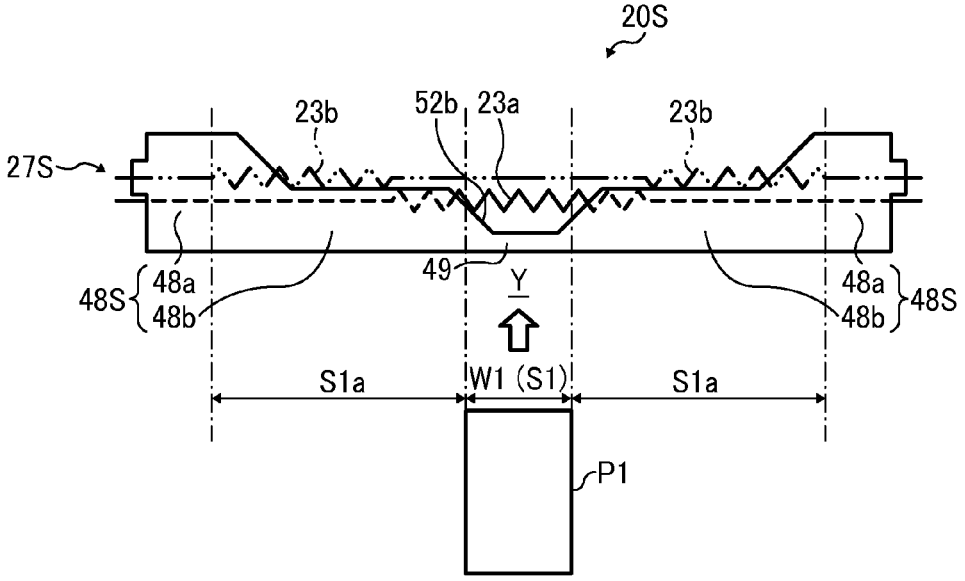
FIG. 10 is a partial schematic diagram of the fixing device shown in FIG. 9 illustrating a heat shield incorporated therein that is situated at the shield position.

With reference to FIGS. 9 and 10, a description is provided of a configuration of a fixing device 20S incorporating a heat shield 27S according to another exemplary embodiment.

FIG. 9 is a schematic diagram of the fixing device 20S. FIG. 10 is a partial schematic diagram of the fixing device 20S. As shown in FIG. 9, the heat shield 27S includes a pair of shield portions 48S disposed at both lateral ends of the heat shield 27S in an axial direction thereof, respectively. Each of the shield portions 48S has two steps. For example, each shield portion 48S includes an outboard, small shield section 48*a* having a decreased length in a longitudinal direction of the heat shield 27S parallel to the axial direction thereof and an inboard, great shield section 48*b* having an increased length in the longitudinal direction of the heat shield 27S. The bridge 49 bridges the great shield section 48*b* of one shield portion 48S serving as a primary shield portion situated at one lateral end of the heat shield 27S and the great shield section 48*b* of another shield portion 48S serving as a secondary shield portion situated at another lateral end of the heat shield 27S in the axial direction thereof. The small shield section 48*a* is contiguous to the great shield section 48*b* substantially in the shield direction Y.

A sloped edge 52*a*, that is, an inboard edge of the small shield section 48*a* in the axial direction of the heat shield 27S, is disposed opposite another sloped edge 52*a*, that is, an inboard edge of another small shield section 48*a* in the axial direction of the heat shield 27S. Similarly, a sloped edge 52*b*, that is, an inboard edge of the great shield section 48*b* in the axial direction of the heat shield 27S, is disposed opposite another sloped edge 52*b*, that is, an inboard edge of another great shield section 48*b* in the axial direction of the heat shield 27S.

The two sloped edges 52*b* of the great shield sections 48*b* are angled relative to the bridge 49 such that an interval between the two sloped edges 52*b* in the axial direction of the heat shield 27S increases gradually in the shield direction Y. Similarly, the two sloped edges 52*a* of the small shield sections 48*a* are angled relative to the bridge 49 such that an interval between the two sloped edges 52*a* in the axial direction of the heat shield 27S increases gradually in the shield direction Y. Unlike the heat shield 27 depicted in FIG. 7, the heat shield 27S does not incorporate the circumferentially straight edges 51.

At least four sizes of recording media P, including a small recording medium P1, a medium recording medium P2, a large recording medium P3, and an extra-large recording medium P4, are available in the fixing device 20S. For example, the small recording medium P1 includes a postcard having a width of 100 mm. The medium recording medium P2 includes an A4 size recording medium having a width of 210 mm. The large recording medium P3 includes an A3 size recording medium having a width of 297 mm. The extra-large recording medium P4 includes an A3 extension size recording medium having a width of 329 mm. However, the small recording medium P1, the medium recording medium P2, the large recording medium P3, and the extra-large recording medium P4 may include recording media of other sizes.

A width W1 of the small recording medium P1 is smaller than the length of the center heat generator 23*a* in a longitudinal direction of the halogen heater pair 23 parallel to the axial direction of the heat shield 27S. The sloped edge 52*b* of the great shield section 48*b* overlaps a side edge of the small recording medium P 1. The sloped edge 52*a* of the small shield section 48*a* overlaps a side edge of the large recording medium P3. It is to be noted that a description of the relation between the position of recording media other than the small recording medium P1, that is, the medium recording medium P2, the large recording medium P3, and the extra-large recording medium P4, and the position of the center heat generator 23*a* and the lateral end heat generators 23*b* of the fixing device 20S is omitted because it is similar to that of the fixing device 20 described above.

As the small recording medium P1 is conveyed through the fixing nip N, the center heat generator 23*a* is turned on. However, since the center heat generator 23*a* heats the conveyance span S2 on the fixing belt 21 corresponding to the width W2 of the medium recording medium P2 that is greater than the width W1 of the small recording medium P1, the controller moves the heat shield 27S to the shield position shown in FIG. 10. At the shield position shown in FIG. 10, each great shield section 48*b* of the heat shield 27S shields the fixing belt 21 from the center heat generator 23*a* in an outboard span S1*a* outboard from a conveyance span S1 corresponding to the width W1 of the small recording medium P1 in the axial direction of the fixing belt 21. Accordingly, the fixing belt 21 does not overheat in each outboard span S1*a* where the small recording medium P1 is not conveyed over the fixing belt 21.

As the medium recording medium P2, the large recording medium P3, and the extra-large recording medium P4 are conveyed through the fixing nip N, the controller performs a control for controlling the halogen heater pair 23 and the heat shield 27S that is similar to the control for controlling the halogen heater pair 23 and the heat shield 27 described above. In this case, each small shield section 48*a* of the heat shield 27S shields the fixing belt 21 from the halogen heater pair 23 as each shield portion 48 of the fixing device 20 does.

Like the shield portion 48 of the fixing device 20 that has the sloped edge 52, the small shield section 48*a* and the great shield section 48*b* have the sloped edges 52*a* and 52*b*, respectively. Accordingly, by changing the rotation angled position of the heat shield 27S, the controller changes the span on the fixing belt 21 shielded from the center heat generator 23*a* and the lateral end heat generators 23*b* of the halogen heater pair 23 by the small shield section 48*a* and the great shield section 48*b* of each shield portion 48S.

Incidentally, the heat shields 27 and 27S formed in a thin plate have a decreased mechanical strength. For example, a circumferential length of the heat shields 27 and 27S in a circumferential direction, that is, a moving direction, perpendicular to the longitudinal direction thereof is smallest at the bridge 49 and therefore the mechanical strength of the bridge 49 is smaller than any other part of the heat shields 27 and 27S. Since the driver 46 is connected to one lateral end of the heat shield 27 in the longitudinal direction thereof as shown in FIG. 6, as the driver 46 drives and rotates the heat shield 27, the bridge 49 may be twisted or bent due to its decreased mechanical strength. If the heat shield 27 is deformed as it is twisted or bent, the heat shield 27 may not achieve proper performance.

To address this circumstance, the heat shields 27 and 27S are configured to suppress deformation such as twisting and bending caused by the decreased mechanical strength thereof as described below with reference to FIGS. 11 to 15. It is to be noted that although FIGS. 11 to 14 illustrate the heat shield 27S having the small shield section 48*a* and the great shield section 48*b*, the heat shield 27S may be replaceable with the heat shield 27 shown in FIG. 7.

With reference to FIGS. 11 to 14, a description is provided of four examples of a reinforcement configured to enhance the mechanical strength of the heat shield 27S.

Figure 11:
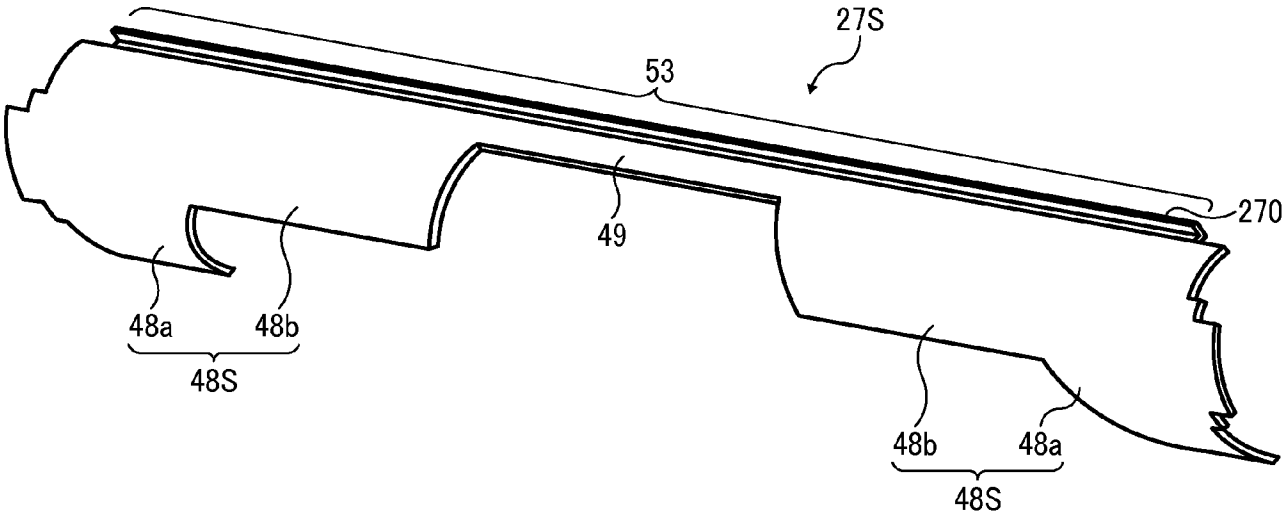
FIG. 11 is a perspective view of the heat shield shown in FIG. 10 mounting a reinforcement as a first example.

FIG. 11 is a perspective view of the heat shield 27S mounting a reinforcement 53 as a first example. As shown in FIG. 11, the heat shield 27S mounts the reinforcement 53 that enhances the mechanical strength of the heat shield 27S. The reinforcement 53 includes an edge portion 270 contiguous to a long edge of the heat shield 27S and extending in the longitudinal direction of the heat shield 27S substantially throughout a long length of the heat shield 27S. The edge portion 270 is bent in a direction perpendicular to the longitudinal direction of the heat shield 27S. For example, the edge portion 270 is bent radially at the right angle.

Figure 12:
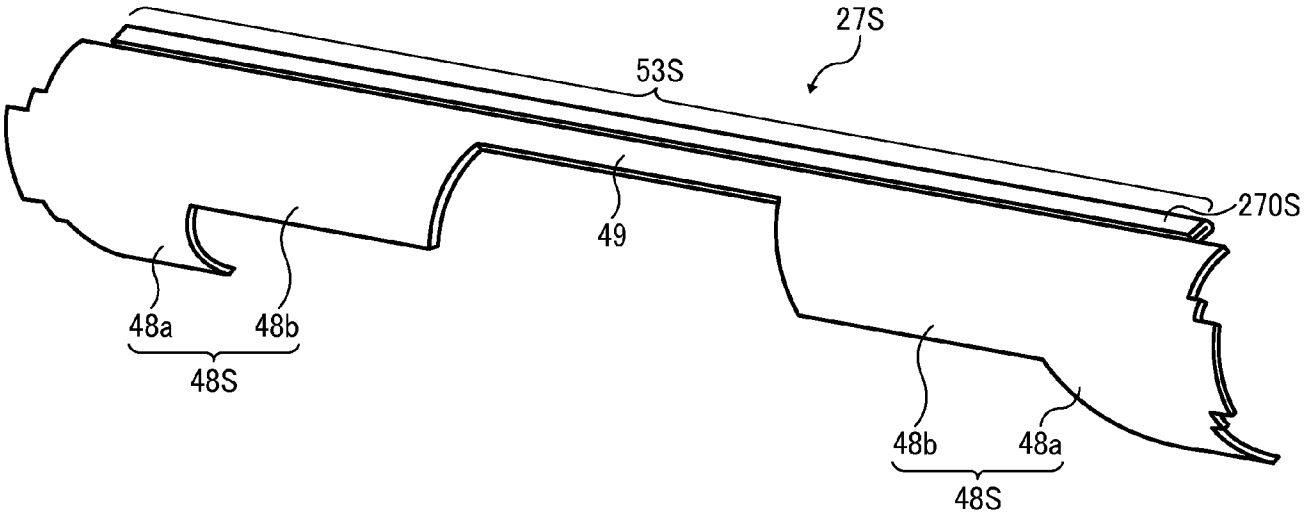
FIG. 12 is a perspective view of the heat shield shown in FIG. 10 mounting a reinforcement as a second example.

FIG. 12 is a perspective view of the heat shield 27S mounting a reinforcement 53S as a second example. As shown in FIG. 12, the heat shield 27S mounts the reinforcement 53S that enhances the mechanical strength of the heat shield 27S. The reinforcement 53S includes an edge portion 270S contiguous to the long edge of the heat shield 27S and extending in the longitudinal direction of the heat shield 27S substantially throughout the long length of the heat shield 27S. The edge portion 270S is folded and layered.

Figure 13:
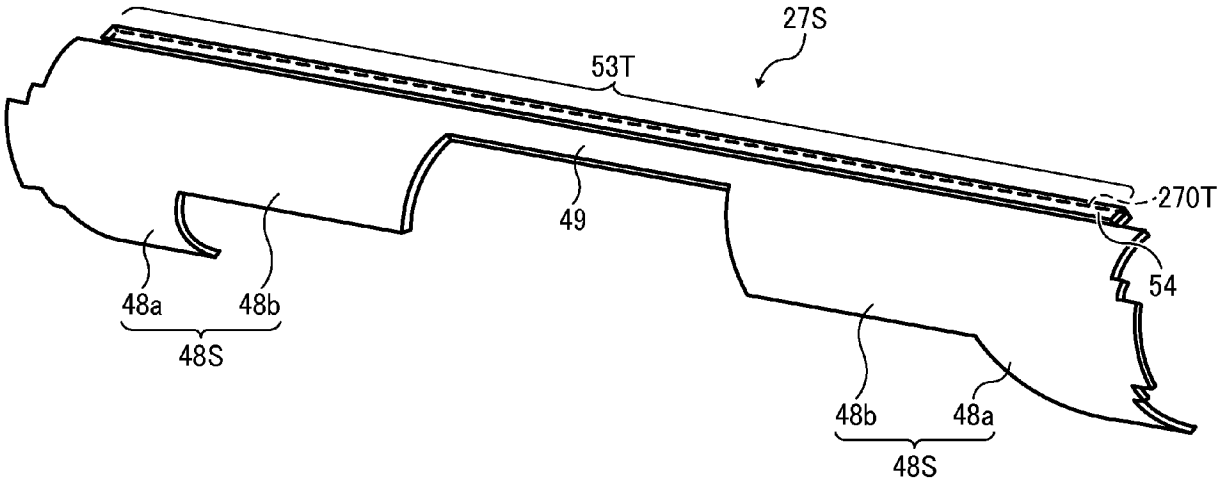
FIG. 13 is a perspective view of the heat shield shown in FIG. 10 mounting a reinforcement as a third example.

FIG. 13 is a perspective view of the heat shield 27S mounting a reinforcement 53T as a third example. As shown in FIG. 13, the heat shield 27S mounts the reinforcement 53T that enhances the mechanical strength of the heat shield 27S. The reinforcement 53T includes an edge portion 270T contiguous to the long edge of the heat shield 27S and extending in the longitudinal direction of the heat shield 27S substantially throughout the long length of the heat shield 27S. The edge portion 270T mounts a supplemental reinforcement portion 54 extending throughout a longitudinal direction of the edge portion 270T. The supplemental reinforcement portion 54 is attached to the edge portion 270T of the reinforcement 53T by welding, for example.

Figure 14:
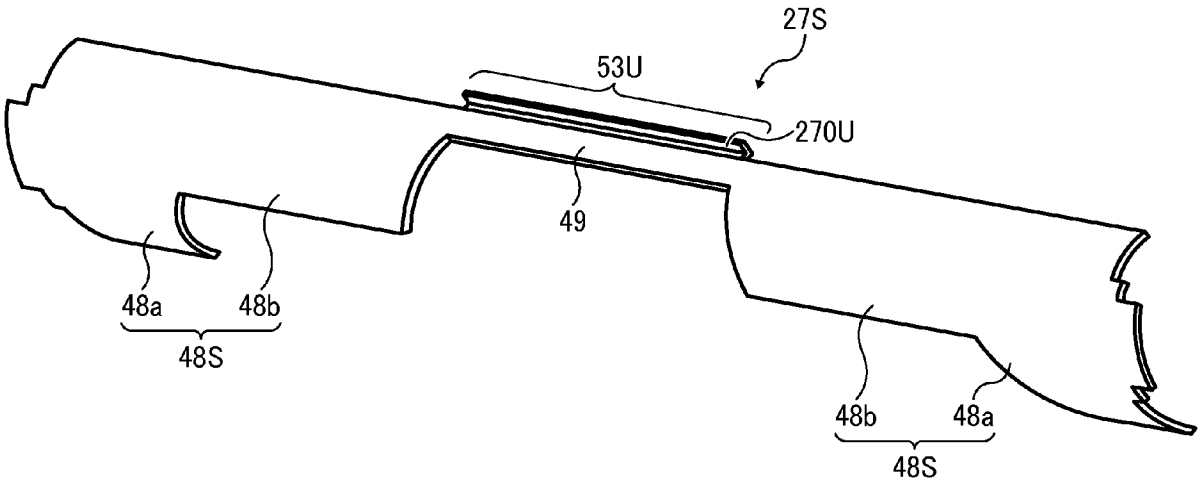
FIG. 14 is a perspective view of the heat shield shown in FIG. 10 mounting a reinforcement as a fourth example.

FIG. 14 is a perspective view of the heat shield 27S mounting a reinforcement 53U as a fourth example. As shown in FIG. 14, the heat shield 27S mounts the reinforcement 53U that enhances the mechanical strength of the heat shield 27S. The reinforcement 53U is mounted on a narrow portion of the heat shield 27S that has a decreased width in a direction perpendicular to the longitudinal direction of the heat shield 27S, that is, the bridge 49 of the heat shield 27S. The reinforcement 53U includes an edge portion 270U bent in the direction perpendicular to the longitudinal direction of the heat shield 27S. The reinforcements 53, 53S, and 53T shown in FIGS. 11 to 13, respectively, extend substantially throughout the long length of the heat shield 27S. Alternatively, if the heat shield 27S has a sufficient mechanical strength at a part other than the bridge 49, the reinforcement 53U may be mounted on the heat shield 27S at the bridge 49 thereof having a relatively small mechanical strength as shown in FIG. 14. It is to be noted that the reinforcements 53, 53S, 53T, and 53U may also be mounted on the heat shield 27 shown in FIG. 7.

Figure 15:
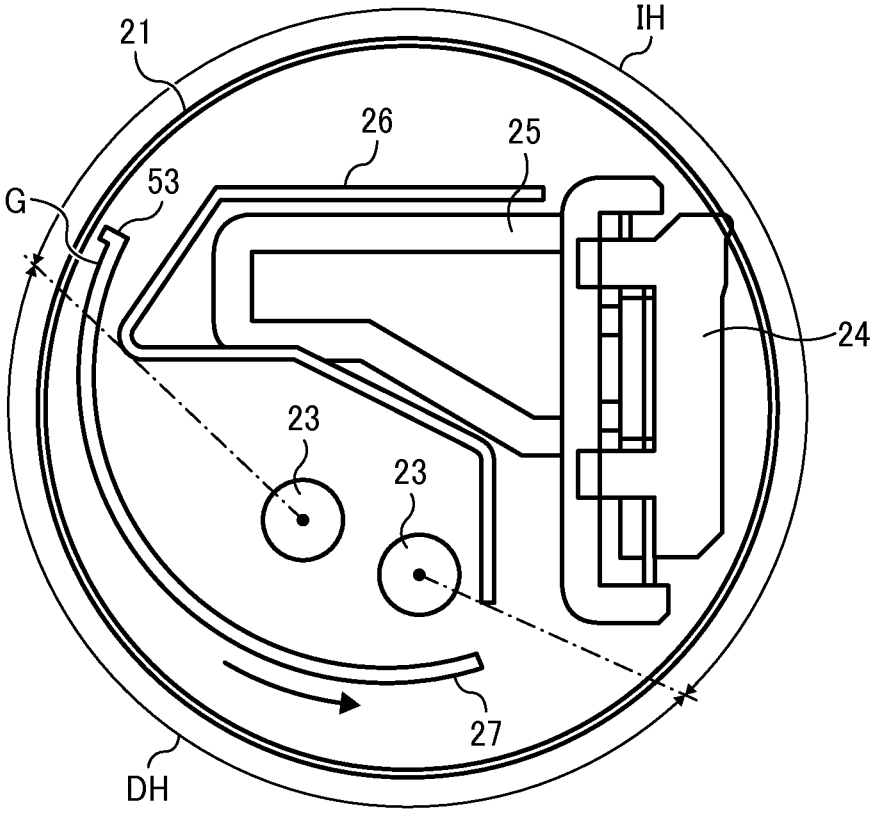
FIG. 15 is a vertical sectional view of a fixing belt incorporated in the fixing device shown in FIG. 2 and components situated inside the fixing belt.

With reference to FIG. 15, a description is provided of location of the reinforcement 53.

The location of the reinforcement 53 described below is also applicable to the reinforcements 53S, 53T, and 53U. FIG. 15 is a vertical sectional view of the fixing belt 21 and the components situated inside the fixing belt 21. As shown in FIG. 15, the direct heating span DH defines a circumferential span on the fixing belt 21 where the halogen heater pair 23 heats the fixing belt 21 directly. The indirect heating span IH defines a circumferential span on the fixing belt 21 other than the direct heating span DH where blocks, that is, the reflector 26, the stay 25, and the nip formation assembly 24, are interposed between the halogen heater pair 23 and the fixing belt 21 and therefore the halogen heater pair 23 heats the fixing belt 21 indirectly. FIG. 15 illustrates the heat shield 27 at the shield position where the heat shield 27 shields the fixing belt 21 from the halogen heater pair 23 in an increased area on the fixing belt 21.

When the heat shield 27 is at the shield position shown in FIG. 15, a part G of the heat shield 27 is disposed opposite the indirect heating span IH. That is, wherever the heat shield 27 moves, the part G of the heat shield 27 is not heated by the halogen heater pair 23 directly. Accordingly, it is preferable to locate the reinforcement 53 on the part G of the heat shield 27 that escapes from direct heating by the halogen heater pair 23 even when the heat shield 27 moves to the shield position. Accordingly, the reinforcement 53 is interposed between the reflector 26 serving as the block and the fixing belt 21. Consequently, the reinforcement 53 is less susceptible to heat from the halogen heater pair 23, suppressing thermal deformation of the reinforcement 53. Thus, the reinforcement 53 achieves enhanced performance.

As described above, the reinforcement (e.g., the reinforcements 53, 53S, 53T, and 53U) reinforces the heat shield (e.g., the heat shields 27 and 27S) effectively, enhancing the mechanical strength of the heat shield. Even if the heat shield is driven by the driver 46 connected to one lateral end of the heat shield in the axial direction thereof as shown in FIG. 6, the reinforcement mounted on the heat shield prevents the heat shield from being twisted or bent, resulting in enhanced performance of the heat shield.

The present invention is not limited to the details of the exemplary embodiments described above, and various modifications and improvements are possible. For example, as shown in FIGS. 11 to 14, the reinforcements 53, 53S, 53T, and 53U are mounted on the heat shield 27S having the two steps created by the small shield section 48*a* and the great shield section 48*b* as shown in FIG. 9. Alternatively, the reinforcements 53, 53S, 53T, and 53U may be mounted on the heat shield 27 having the single step created by the shield portion 48 as shown in FIG. 7 or a heat shield having three or more steps.

The reinforcements 53, 53S, 53T, and 53U are mounted on the heat shields 27 and 27S that shield the fixing belt 21 from the halogen heater pair 23 serving as a heater. Alternatively, the reinforcements 53, 53S, 53T, and 53U may be mounted on the heat shields 27 and 27S that shield the fixing belt 21 from other heaters, for example, an induction heater for generating a magnetic flux used to heat the fixing belt 21. In this case, the heat shields 27 and 27S shield the fixing belt 21 from the magnetic flux from the induction heater.

As shown in FIGS. 7 and 9, the shield portions 48 and 48S are disposed at both lateral ends of the heat shields 27 and 27S in the longitudinal direction thereof, respectively. Alternatively, the shield portions 48 and 48S may be disposed at one lateral end of the heat shields 27 and 27S in the longitudinal direction thereof, respectively. In this case, the recording medium P is conveyed over the fixing belt 21 along one lateral edge of the fixing belt 21 in the axial direction thereof and the shield portions 48 and 48S are disposed in proximity to another lateral edge of the fixing belt 21 in the axial direction thereof. According to the exemplary embodiments described above, the fixing belt 21 serves as a fixing rotary body. Alternatively, a fixing roller or the like may be used as a fixing rotary body. Further, the pressing roller 22 serves as an opposed body. Alternatively, a pressing belt or the like may be used as an opposed body.

A description is provided of advantages of the fixing devices 20 and 20S.

As shown in FIGS. 2 and 6, the fixing devices 20 and 20S include a fixing rotary body (e.g., the fixing belt 21) rotatable in the rotation direction R3; a heater (e.g., the halogen heater pair 23) to heat the fixing rotary body; an opposed body (e.g., the pressing roller 22) contacting the fixing rotary body to form the fixing nip N therebetween through which a recording medium P is conveyed; a heat shield (e.g., the heat shields 27 and 27S) to shield the fixing rotary body from light or heat radiated from the heater; and a driver (e.g., the driver 46) connected to the heat shield to drive and move the heat shield between the shield position shown in FIG. 2 where the heat shield is interposed between the heater and the fixing rotary body to shield the fixing rotary body from the heater and the retracted position shown in FIG. 3 where the heat shield is retracted from the shield position. The heat shield mounts a reinforcement (e.g., the reinforcements 53, 53S, 53T, and 53U) on a long edge of the heat shield. Accordingly, the reinforcement enhances the mechanical strength of the heat shield.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

a heater disposed within the fixing rotary body and heating a first circumferential portion of the fixing rotary body directly and a second circumferential portion of the fixing rotary body indirectly as a result of a static object between the heater and the fixing rotary body in the second circumferential portion;

an opposed body contacting the fixing rotary body to form a fixing nip therebetween through which a recording medium is conveyed;

a heat shield that includes a pair of shield portions at both lateral ends in an axial direction of the fixing rotary body to shield end portions of the fixing rotary body from the heater, and a bridging portion between the shield portions, wherein a width of the bridging portion in a direction perpendicular to a longitudinal direction of the heat shield is smaller than a width of the shield portions, and wherein the bridging portion and the shield portions share a long edge of the heat shield;

a driver connected to the heat shield to move the heat shield in a circumferential direction of the fixing rotary body between a shield position where the shield portions are interposed between the heater and the end portions of the fixing rotary body for an increased amount in the first circumferential portion and a retracted position where the shield portions are interposed between the heater and the end portions of the fixing rotary body for a decreased amount in the first circumferential portion; and a reinforcement mounted on the long edge of the heat shield, wherein when the heat shield is in the shield position, the long edge of the heat shield is between the heater and the fixing rotary body in the second circumferential portion and the shield portions of the heat shield are between the heater and the fixing rotary body in the first circumferential portion.

2. The fixing device according to claim 1, wherein the driver is connected to one lateral end of the heat shield in the longitudinal direction thereof.

3. The fixing device according to claim 1, wherein the heat shield includes a thin plate made of one of metal and ceramic.

4. The fixing device according to claim 1, wherein the reinforcement includes an edge portion contiguous to the heat shield and extending in the longitudinal direction of the heat shield substantially throughout a long length of the heat shield, the edge portion being bent.

5. The fixing device according to claim 4, wherein the edge portion is bent in a direction perpendicular to the longitudinal direction of the heat shield.

6. The fixing device according to claim 5, wherein the edge portion is bent radially at a right angle.

7. The fixing device according to claim 4, wherein the edge portion is folded and layered.

8. The fixing device according to claim 1, wherein the reinforcement includes:

an edge portion contiguous to the heat shield and extending in the longitudinal direction of the heat shield substantially throughout a long length of the heat shield; and a supplemental reinforcement portion mounted on the edge portion and extending throughout a long length of the edge portion.

9. The fixing device according to claim 8, wherein the supplemental reinforcement portion is attached to the edge portion by welding.

10. The fixing device according to claim 1, further comprising a block, interposed between the heater and the fixing rotary body, to block heat from the heater, wherein the reinforcement is interposed between the block and the fixing rotary body.

11. The fixing device according to claim 10, wherein the block includes a reflector disposed opposite an inner circumferential surface of the fixing rotary body to reflect light radiated from the heater to the fixing rotary body.

12. The fixing device according to claim 1, wherein the fixing rotary body includes an endless belt.

13. The fixing device according to claim 1, wherein the opposed body includes a pressing roller.

14. An image forming apparatus comprising the fixing device according to claim 1.

15. The fixing device of claim 1, wherein:

a circumference of the fixing rotary body comprises the first circumferential portion and the second circumferential portion, wherein components of the fixing device other than the heat shield are disposed between the heater and the fixing rotary body in the second circumferential portion.

16. The fixing device of claim 15, wherein:

the long edge of the heat shield is located in area which corresponds with the second circumferential portion in both the shield position and the retracted position.

17. The fixing device of claim 15, wherein at least one of the components is a reflector.

18. A fixing device comprising:

a fixing rotary body rotatable in a predetermined direction of rotation;

a heater disposed within the fixing rotary body and heating the fixing rotary body;

an opposed body contacting the fixing rotary body to form a fixing nip therebetween through which a recording medium is conveyed;

a heat shield that includes a pair of shield portions at both lateral ends in an axial direction of the fixing rotary body to shield end portions of the fixing rotary body from the heater, and a bridging portion between the shield portions, wherein a width of the bridging portion in a direction perpendicular to a longitudinal direction of the heat shield is smaller than a width of the shield portions, wherein the bridging portion and the shield portions share a long edge of the heat shield;

a driver connected to the heat shield to move the heat shield in a circumferential direction of the fixing rotary body; and a reinforcement mounted on the long edge of the heat shield, wherein the reinforcement includes an edge portion that is bent and contiguous to the heat shield in the longitudinal direction of the heat shield.

19. An image forming apparatus comprising the fixing device according to claim 18.

20. A fixing device comprising:

a heater disposed within the fixing rotary body and heating the fixing rotary body;

an opposed body contacting the fixing rotary body to form a fixing nip therebetween through which a recording medium is conveyed;

a heat shield that includes a pair of shield portions at both lateral ends in an axial direction of the fixing rotary body to shield end portions of the fixing rotary body from the heater, and a bridging portion between the shield portions, wherein a width of the bridging portion in a direction perpendicular to a longitudinal direction of the heat shield is smaller than a width of the shield portions, wherein the bridging portion and the shield portions share a long edge of the heat shield;

a driver connected to the heat shield to move the heat shield in a circumferential direction of the fixing rotary body; and a reinforcement mounted on the long edge of the heat shield, wherein the reinforcement includes:

an edge portion contiguous to the heat shield and extending in the longitudinal direction of the heat shield substantially throughout a long length of the heat shield; and a supplemental reinforcement portion mounted on the edge portion and extending throughout a long length of the edge portion.

21. An image forming apparatus comprising the fixing device according to claim 20.

* * * * *